US006997481B1

(12) United States Patent
Hardwig

(10) Patent No.: US 6,997,481 B1
(45) Date of Patent: Feb. 14, 2006

(54) CHECKBOOK COVER

(76) Inventor: Paul Hardwig, 4239 4th St. S., St. Cloud, MN (US) 56301

( * ) Notice: Subject to any disclaimer, the term of this patent is extended or adjusted under 35 U.S.C. 154(b) by 0 days.

(21) Appl. No.: 11/009,199

(22) Filed: Dec. 10, 2004

Related U.S. Application Data

(60) Provisional application No. 60/585,876, filed on Jul. 6, 2004.

(51) Int. Cl.
*B42D 3/00* (2006.01)

(52) U.S. Cl. ..... 281/29; 281/30; 281/31; 283/57; 283/58; 283/64; 150/131; 150/132; 150/135; 206/38; 206/232; D3/247; D3/249; D3/253

(58) Field of Classification Search ..... 281/29, 281/30, 31; 283/57, 58, 64; 150/131, 132, 150/135; 206/38, 232; D3/247, 249, 253
See application file for complete search history.

(56) References Cited

U.S. PATENT DOCUMENTS

| | | | | | |
|---|---|---|---|---|---|
| 637,889 | A | | 11/1899 | Parker et al. | |
| 672,723 | A | | 4/1901 | Vernon | |
| 702,107 | A | | 6/1902 | Loomis | |
| 781,948 | A | | 2/1905 | Hegele | |
| 863,036 | A | | 8/1907 | Mieden | |
| 896,221 | A | | 8/1908 | Lynch | |
| 1,489,796 | A | | 4/1924 | Stoughton | |
| 2,066,992 | A | | 1/1937 | Matson | |
| 2,450,558 | A | | 10/1948 | Ogren | |
| 2,647,071 | A | | 7/1953 | Schade | |
| 2,663,095 | A | * | 12/1953 | Chase | 434/410 |
| 2,904,899 | A | * | 9/1959 | Lloyd | 434/109 |
| 3,267,841 | A | | 8/1966 | Metcalf | |
| 3,267,980 | A | | 8/1966 | Bird | |
| 3,564,668 | A | | 2/1971 | Kirk | |
| 4,055,008 | A | * | 10/1977 | Bell | 40/405 |
| 4,075,702 | A | | 2/1978 | Davies | |
| 4,153,275 | A | | 5/1979 | Phillips | |
| 4,391,457 | A | * | 7/1983 | Gassner | 281/31 |
| 4,566,721 | A | * | 1/1986 | Friedman et al. | 281/31 |
| 4,640,018 | A | * | 2/1987 | Gigliotti | 33/562 |

(Continued)

FOREIGN PATENT DOCUMENTS

GB 00529875 * 11/1940

OTHER PUBLICATIONS

Extra Mile Promotional Products, http://www.extramile-.com/fold/ckbook.hrm. Nov. 10, 2003, 3 pages, Extra Mile Enterprizes.

(Continued)

*Primary Examiner*—Boyer Ashley
*Assistant Examiner*—Mark Henderson
(74) *Attorney, Agent, or Firm*—Albert W. Watkins

(57) ABSTRACT

A checkbook cover has an exterior cover, an interior check and register holder affixed adjacent to the cover, and a slot formed through the exterior cover. A writing instrument, preferably with a pocket clip thereon, passes partially through the exterior cover slot to a chamber between exterior cover and interior check and register holder. The pocket clip encompasses at least a part of the exterior cover. The checkbook cover is formed using standard sheet processing techniques, but includes the additional step of severing at a selected strategic internal location to form the slot. Additional force distributors, preferably in the form of circular cut-outs, may be formed at the terminations of the slot. Heat stamped reinforcements are provided in the preferred embodiment about the slot and force distributors, to further strengthen the cover.

8 Claims, 4 Drawing Sheets

U.S. PATENT DOCUMENTS

| | | | | | |
|---|---|---|---|---|---|
| 4,716,948 | A | | 1/1988 | Brissette | |
| 4,751,664 | A | * | 6/1988 | Holm | 708/106 |
| 5,011,188 | A | | 4/1991 | Zoland et al. | |
| 5,190,317 | A | | 3/1993 | Zoland | |
| D352,963 | S | | 11/1994 | Siler | |
| D358,839 | S | * | 5/1995 | Lipic | D19/26 |
| D366,146 | S | | 1/1996 | Bertrand | |
| 5,544,750 | A | | 8/1996 | Randall | |
| 5,560,652 | A | * | 10/1996 | Zoland | 281/30 |
| 5,778,954 | A | * | 7/1998 | Sullivan et al. | 150/143 |
| D405,605 | S | | 2/1999 | Zimmerman | |
| D422,406 | S | * | 4/2000 | Dweck et al. | D3/247 |
| 6,619,349 | B1 | * | 9/2003 | Gribovsky | 150/135 |

OTHER PUBLICATIONS

TPK Golf "Get Checkmate, The Leather Checkbook Cover That Also Holds Your Cash & Cards", http://tpkgolf.com/checkbook.html, Dec. 12, 2003, 2 pages.

http://www.onestopknifeshop.com/images/spec-ops/sop-checkbookholder.jpg Dec. 12, 2003, 1 page.

* cited by examiner

CHECKBOOK COVER

CROSS REFERENCE TO RELATED APPLICATIONS

This application claims priority to U.S. provisional patent application Ser. No. 60/585,876 filed Jul. 6, 2004 of common title and inventorship, the entire contents which are incorporated herein by reference.

BACKGROUND OF THE INVENTION

1. Field of the Invention

This invention pertains generally to purses, wallets, and protective covers, and more particularly to protective check covers and holders. In the most preferred embodiment, a checkbook cover has a pen receiving slot formed therein to encompass and retain a pen strategically therein.

2. Description of the Related Art

In ancient history, mankind was hindered in trade by difficult conversions between individuals. Directly trading one item for another was traditionally complicated, since one or the other party might not like the goods being gained through exchange, and so might not favorably value them. This could and frequently did lead to a failed trading attempt. With the advent of currency, in early form in jewels, precious metals, and then coins minted from the precious metals, and later paper, mankind has been greatly facilitated in the bartering and retail trades, since the currency forms a simple exchange medium through which all goods and services may be valued or priced.

While monetary currency facilitated trading, certain risks have been involved therewith. Most troublesome has been the loss of such currency, either through mishap or theft. Monetary currency has always been difficult, of not impossible, to recover or trace.

A more safe alternative to semi-precious materials or paper currency has been a check, whether personal, bank, or otherwise. These checks represent an authorization for a particular party, as named on the check, to draw upon funds held in the account, in an amount specified directly on the check. By specifying the recipient and amount, the check is generally worthless to anyone other than the designated recipient. If the check is lost, nothing other than the paper, printing and time to prepare the draft is lost. This is typically only a few pennies or dollars worth of loss, depending upon how the check was lost and what additional security measures may be required as a result of the loss. Nevertheless, such loss is generally minor, and inconsequential to the overall amounts at issue.

While checks do provide an added layer of security over simple cash, they still suffer some drawbacks. Among these is the ease by which one or several checks may be forgotten about. Once forgotten, while the check is in transit, a person may readily draw beyond the funds available in the account. Such problems of over-drafting a checking account are very common. Check registers are provided in various forms which may be used at the time of issuance of a bank draft or check to record the writing of the check, typically including the amount of the check, to whom it was written, and the purpose the check has been put to. But, both the check and register require some type of writing instrument or utensil, such as the common ball point pen. This need is not new. However, and in spite of many attempts, no fully adequate method for providing the writing instrument with the register and checks has been put to widespread use prior to the present disclosure.

A variety of constructions have heretofore have been disclosed to hold a writing instrument in a cover. Several patents are incorporated herein by reference for their teachings, including U.S. Pat. No. 3,267,841 to Metcalf; 781,948 to Hegele; Des. 366,146 to Bertrand; Des. 422,406 to Dweck et al; U.S. Pat. No. 863,036 to Mieden; and U.S. Pat. No. 2,450,558 to Ogren. These patents variously illustrate pockets and loops which have been provided to accommodate the writing instrument. However, those who are familiar with loops will understand that the loop is very limited to the size of pen which will be reliably secured therein. If the pen is too large, the loop will tear or fail to accept the pen. If the loop is too large for the pen, the pen will readily slide from the loop and be lost. There is much frustration losing a valuable or favored writing instrument, simply because the holder did not adequately secure the pen. Worse, when these loops are fabricated from vinyl, even a temporary storage of a larger diameter writing instrument may permanently stretch the loop, rendering it useless for previously satisfactory writing instruments. Finally, a loop also may disadvantageously expose the writing end of the writing instrument to undesirable contact, which may lead to bleeding of ink from a pen or breakage or snagging of pencil lead and other components.

While the various pockets provide a number of advantages, including shielding of the writing utensil from exposure or damage to the writing point, these have heretofore required additional fabrication and expense which is most undesirable from a cost and convenience perspective. The present checkbook cover is manufactured from sheet vinyl, and is laminated as only two layers. The ultimate exterior cover is usually opaque, and colored to the desires of the consumer. The interior layer is often transparent, and has suitable geometry to allow ready retention of both the checks and also the check register. These layers are processed in flat form in very high volume from sheet, and are consequently manufactured for very low cost. Any changes from or which interfere with the sheet production techniques will very adversely impact the ultimate sales of the product, which presently sell for little more than the cost of the materials. As a result, the fabrication of pockets, which typically requires additional lamination or assembly, and which cannot be handled in line with the ordinary sheet processing, has not proved to be adequate for consumers to widely adopt such designs, even where only marginally higher costs are required.

A number of additional patents illustrating various concepts are additionally incorporated herein by reference. An example of attaching a writing instrument's pocket clip to a through-hole on one cover surface is illustrated in U.S. Pat. Nos. 5,011,188 and 5,190,317 to Zoland. Other patents include U.S. Pat. No. 3,267,980 to Bird; U.S. Pat. No. 2,647,071 to Schade; and U.S. Pat. No. 702,107 to Loomis. The prior art has failed to provide a method or apparatus for supporting the writing instrument which accommodates writing instruments of varying size and shape, which protects the writing point, and which is readily accessible without opening the cover, while not adding even marginally to the production costs of the cover.

SUMMARY OF THE INVENTION

In a first manifestation, the invention is a checkbook cover cooperative with at least one of a check register and check stack to form a storage chamber accessible from the exterior. The storage chamber accommodates at least one writing instrument therein, while protecting the writing instrument tip from contact or damage. The checkbook cover is fabricated to include an exterior sheet of pliable material which is operative to provide at least limited protection to papers held within. An interior sheet of pliable material forms at least one pocket with the pliable exterior sheet. The pocket is suitable for receiving an exterior of at least one of a check register and check stack. A slot forms an opening passing through the pliable exterior sheet into the storage chamber. The storage chamber is defined by the exterior of the at least one of a check register and check stack and the pliable exterior sheet.

In a second manifestation, the invention is a method of fabricating and using a checkbook cover, using standard fabrication equipment and standard two-sheet lamination. In accord with the method, a perimeter of an exterior cover is formed. A slot is formed fully through the exterior cover and within the perimeter. An interior cover is formed, and the interior and exterior covers are laminated. An exterior of at least one of a check register and check stack is inserted between the exterior cover and interior cover. A writing utensil is inserted between the exterior cover and the exterior of at least one of the check register and check stack.

In a third manifestation, the invention is, in combination, a checkbook cover and a pen. The checkbook cover has an exterior cover, an interior check and register holder affixed adjacent to the cover, and has a slot formed through the exterior cover. The pen has a pocket clip thereon. The pen passes partially through the exterior cover slot to a region between exterior cover and interior check and register holder. The pocket clip encompasses at least a part of the exterior cover.

OBJECTS OF THE INVENTION

Exemplary embodiments of the present invention solve inadequacies of the prior art by providing a checkbook cover which is formed using standard sheet processing techniques, but which includes the additional step of severing at a selected strategic internal location. As a result thereof, the cover may be fabricated without additional production costs, and will provide a highly desirable added benefit not adequately presented in the prior art.

A first object of the invention is to provide a method and apparatus for supporting a writing instrument, the apparatus which accommodates writing instruments of varying size and shape. A second object of the invention is to protect the writing instrument point, and to preferably avoid bleed therefrom. Another object of the present invention is to enable ready access to the pen without opening the cover. A further object of the invention is to add as little as possible to the production costs of the cover. Yet another object of the present invention is to accomplish each of the foregoing objectives while preserving an easy-to-use and understandable construction.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
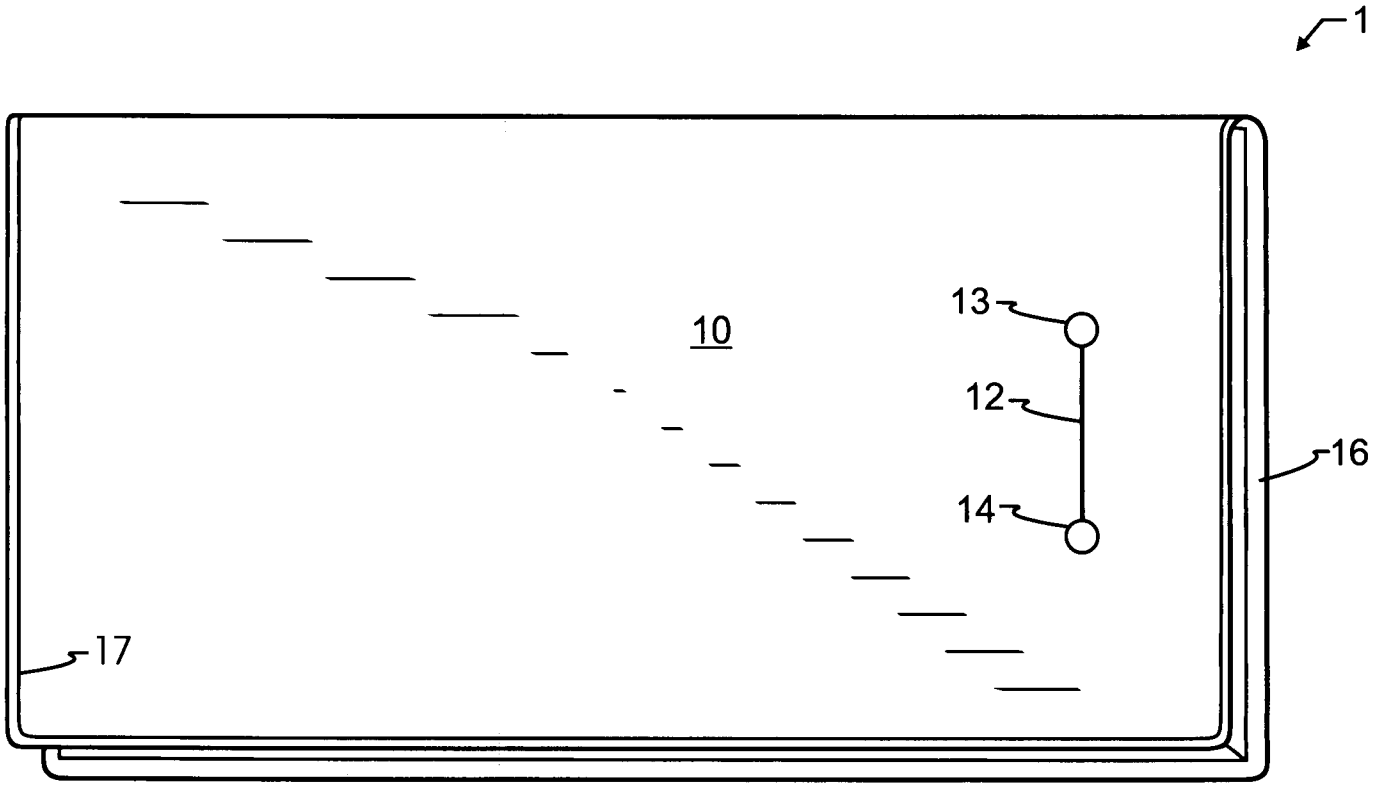
FIG. 1 illustrates a preferred embodiment right-handed checkbook cover designed in accord with the teachings of the present invention from a top and slightly projected view.

In a most preferred embodiment of the invention illustrated in FIG. 1, a checkbook cover 1 resembling those of the prior art has an exterior top surface 10 and bottom surface 16 which wrap about and protect a check register 20 and check stack 30. About the perimeter of cover 1 is a heat-stamping 17, which is simply slightly harder material that tends to be tear-resistant. The improvement found in the present invention includes an additional slot 12 terminated at each end by round holes 13 and 14. Slot 12 preferably passes through the exterior cover, which in the preferred embodiment is fabricated from vinyl. While it is not critical to the performance of the invention exactly when the slot and holes are fabricated into the cover, many of the processes used to form the checkbook cover may be directly applied with only minor modification to permit simultaneous formation. Consequently, for economic reasons, the present slot and round holes will preferably be formed at the time of fabrication of the exterior face 10 of checkbook cover 1. The shaping will preferably be done as the exterior perimeter of cover 1 is being defined, and so will be a part of the same stamping or severing operation. The formation of slot 12 and round holes 13, 14 will also most preferably occur prior to the lamination of exterior faces 10, 16 with inner liner 11. As is known, checkbook covers are generally formed from an opaque exterior vinyl cover and a clear interior plastic, which may or may not also be comprised by vinyl, or other suitable material. In the preferred embodiment, slot 12 and holes 13, 14 will only penetrate through exterior face 10, and will not penetrate through liner 11. While not essential to function, this is preferred to improve the appearance and slightly improve the durability and function of liner 11.

Most typically, vinyl checkbook covers are formed with heat-stamped reinforcement 17 adjacent the edges of the cover, and with heat stamped hinges at the central spine. The heat-stamped reinforcement 17 is known to offer much structural integrity to cover 1, helping to prevent undesirable tearing and the like, while still permitting the bulk of cover 1 to be relatively soft and pliable. Most preferably, heat-stamped reinforcements similar to heat-stamped reinforcement 17 will be applied similarly in areas adjacent the slot and round hole borders found in the present invention, as illustrated by enlarged view in FIG. 3 as heat-stamped reinforcement 18, to provide similar strengthening against tears and the like.

The most preferred terminating holes 13, 14 are provided for similar strengthening. Stretching and subsequent tearing will normally only occur at regions of substantial stress or tension within vinyl. Such forces are typically concentrated adjacent the leading edge of a fault. Slot 12 behaves much like a fault, since the vinyl is separated within the slot, and forces would tend to concentrate at the ends thereof. These forces may be particularly large when a writing instrument 40 is being inserted or removed, or in the event writing instrument 40 is accidentally snagged on another object. However, by forming round holes 13, 14 terminating slot 12, there is no opportunity for any stress concentration at the slot ends. Instead, any tearing or pulling forces will be distributed relatively equally about the perimeter of round holes 13, 14, which, as aforementioned, will most preferably be reinforced by heat stamping 18 or the like. Consequently, round holes 13, 14 act as force distributors which prevent the undesirable destruction of exterior face 10. While the most preferred embodiment incorporates round holes, it will be understood that other geometries may be utilized. Nevertheless, for simplicity and relatively even distribution of forces in the vinyl, round holes are used in the present preferred embodiment.

Figure 2:
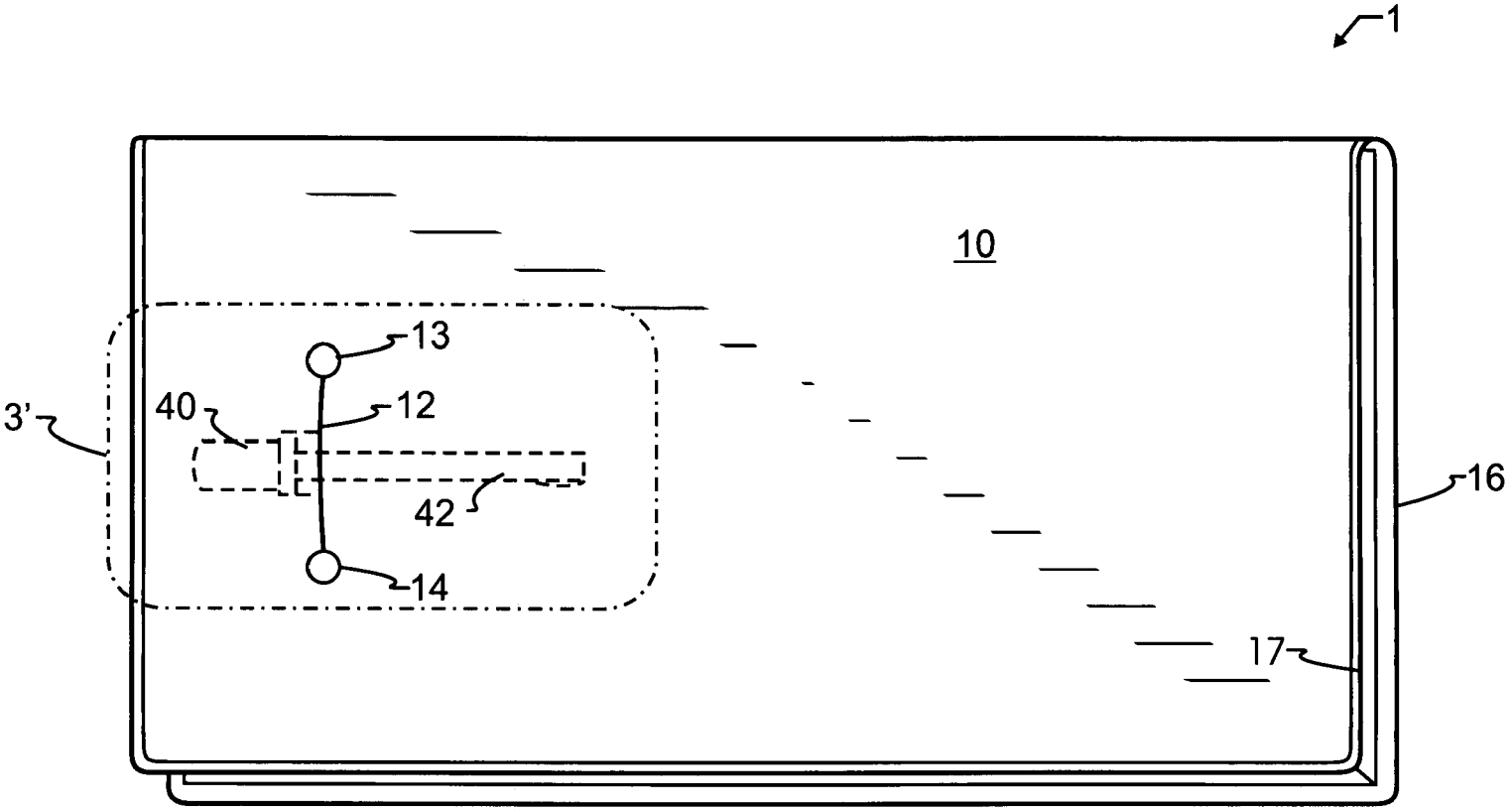
FIG. 2 illustrates the preferred embodiment checkbook cover similar to that of FIG. 1, but in left-handed configuration, and showing the visible components of a properly placed writing instrument, from the same projected view.
Figure 3:
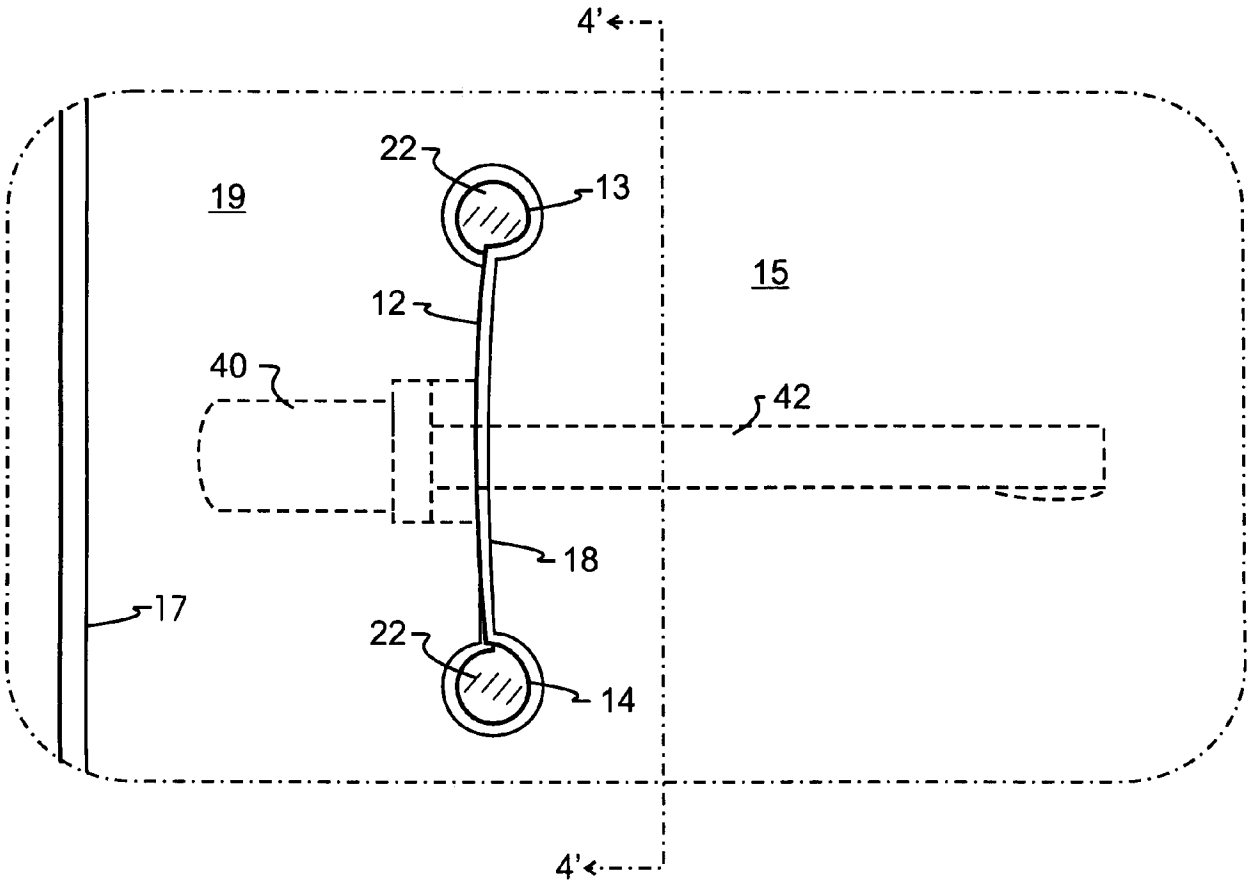
FIG. 3 illustrates the slot and pen combination of FIG. 2 from a magnified view taken along line 3' of FIG. 2.
Figure 4:
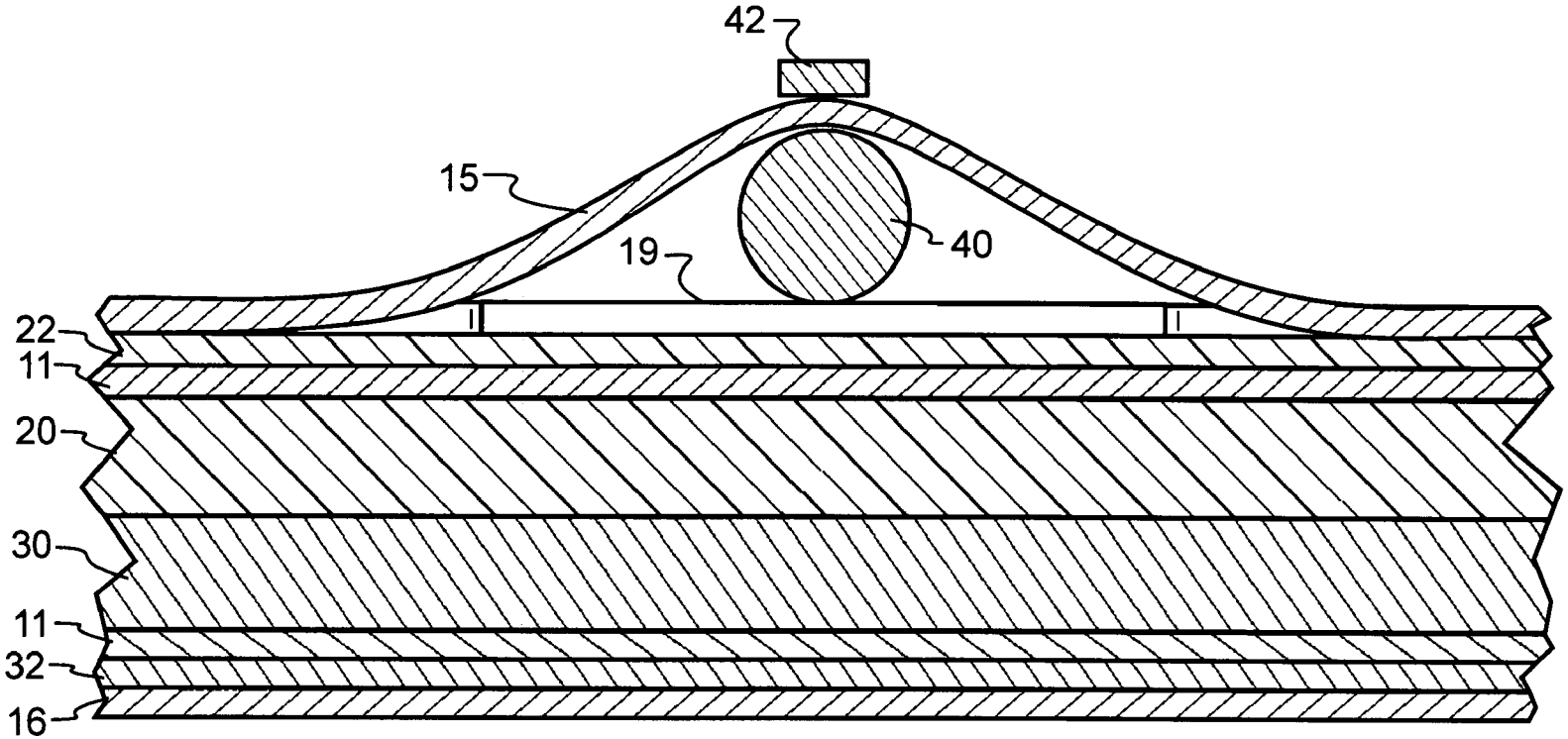
FIG. 4 illustrates a writing instrument in combination with the preferred embodiment checkbook cover, checks and check register from a cross-sectional view taken along line 4' of FIG. 3.

As illustrated in FIGS. 2–4, a prior art writing instrument 40, which might for exemplary purposes include a ball point and a pocket clip 42 of one form or another, may be inserted through slot 12. Most preferably, slot 12 will be positioned more nearly adjacent one edge of exterior cover 10, rather than being centered, such that the pen barrel may pass inside the checkbook cover and not extend beyond the perimeter of cover 1. Those familiar with both writing instruments and checkbook covers will recognize that not all covers are fabricated using the same sets of dimensions, nor are all writing instruments. Consequently, it will not be possible to accommodate every pen with every checkbook cover. Nevertheless, cover 1 will be designed to include a slot 12 placed for the particular writing instruments of preference where the cover is not otherwise of sufficient size to fully accommodate all types and styles.

FIG. 4 illustrates the combination checkbook cover and writing instrument of FIG. 3 by side cross-sectional view, showing the position of the various components. From this figure, it will be apparent that writing instrument 40 will preferably pass behind the commonly card or paperboard outside 22 of check register 20, in a pocket-like space between checkbook register outside 22 and the pocket forming portion 15 of checkbook exterior cover 10. As designated in the figures, the portion of cover 10 which encompasses the barrel of writing instrument 40 is designated by the reference numeral 15, while the pen will lie exterior to the portion of exterior cover 10 designated by reference numeral 19. The effective pocket so formed protects the end of writing instrument 40 distal to clip 42. In the case of a ball point pen, this will be the end adjacent the ball point. The end is preferably protected from undesirable contact or interference with other objects that may be nearby or adjacent to checkbook cover 1. As will be apparent then, in the preferred embodiment, writing instrument 40 is retained within this pocket. While this pocket is not totally sealed, the enclosure effectively encompasses the entire writing instrument body except that portion outside of exterior cover 10 which extends beyond clip 42. Furthermore, as will be apparent, the size of the pocket will ordinarily be such to readily accommodate a wide variety of writing instruments therein. Furthermore, since writing instrument 40 is almost entirely enclosed therein, the risk of loss of writing instrument 40 is greatly reduced. Finally, the stiffness provided by the immediately adjacent check register 20 and check stack 30 provides added rigidity and strength, which help in combination with writing instrument 40 to preserve the integrity of each of the check register 20, check stack 30 and writing instrument 40.

From these figures it will be apparent that holes 13, 14 may be formed in exterior cover 10 either prior to or subsequent to lamination with inner layer 11, but once again, for economic and manufacturing reasons it will normally be most sensible to fabricate holes 13, 14 and slot 12 at the time of fabrication of the outer vinyl. Nevertheless, some manufacturing methods and approaches may dictate otherwise. Consequently, those reasonably skilled in the art of checkbook cover fabrication will make a determination of when the most reasonable time will be to fabricate the holes and slot upon a reading of the present disclosure and upon further consideration of the manufacturing methods already employed or planned for at the intended manufacturing location. Likewise, existing covers may be retrofit, though the heat stamp reinforcement may be more difficult or even impractical in that instance.

From these figures, several additional features and options should become more apparent. First of all, preferred checkbook cover 1 may be manufactured from a variety of materials, including leather, metals, resins and plastics, composites, or even combinations of the above. The specific material used may vary, though the standard vinyl covers are preferred owing to the low cost, ease of fabrication, pliability, relative durability, low weight, lack of potential hazard, and existing manufacturing technique and capacity. By way of the present invention, no other materials are required, which permits unitary or two-layer laminates to be formed relatively simply, reliably, and for very low cost directly from sheet. Essentially, the cost is the same for the preferred embodiment as for the prior art, though it is understood that tooling costs may be slightly higher to include the formation of slot 12, holes 13, 14, and heat-stamped reinforcement 18.

As those skilled in the plastics areas will immediately recognize, while vinyl is preferred, there are a myriad of other materials which may be used alternatively or in combination that will offer similar characteristics and benefits. Consequently, the present invention is not limited to one or a few plastics, but instead the inventor recognizes that many other materials, including composites, laminae, and other such materials may be used. Where plastic sheets are used, it will be understood that various reinforcing fibers or particles, plasticizers, and other ingredients known to enhance the properties of the composition and resulting product may be used.

A variety of designs have been contemplated for the preferred slot 12 and holes 13, 14. As shown in FIGS. 2–4, slot 12 is located adjacent the left top side of checkbook cover 1. In this configuration, the cover is arranged to be most convenient for a typical left-handed person. This is because the left-handed person will draw the pen out of cover 1 by grasping the pen in the left hand, and pulling to the left. However, those of ordinary skill will recognize that slot 12 may also be located adjacent the right top side of cover 1, as illustrated for exemplary purposes in FIG. 1, such that a typical right-handed person may readily grasp the pen in their right hand, and draw it to the right relative to cover 1. Further, slot 12, which in the illustrated preferred embodiment cover 1 is linear, may travel other paths, which may even be rather circuitous. Cover 1, slot 12 and holes 13, 14 may additionally be arranged, patterned or imprinted to resemble other animate or inanimate objects without deviating from the present invention. The materials used for a particular design may be chosen not only based upon other factors such as water resistance, flexibility and durability, but may also factor in the visual characteristics of the particular design.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A checkbook cover cooperative with at least one of a check register and check stack to form a storage chamber accessible from an exterior of said storage chamber for the storing of at least one writing instrument, comprising:

an exterior sheet of pliable material and operative to provide at least limited protection to papers held within said exterior sheet;

an interior sheet of pliable material operative to form at least one pocket with said pliable exterior sheet, said pocket suitable for receiving therein an exterior of said at least one of a check register and check stack; and a slot forming an opening passing through said pliable exterior sheet into said storage chamber, said storage chamber defined by said exterior of said at least one of a check register and check stack and said pliable exterior sheet.

2. The checkbook cover of claim 1, further comprising force distributors terminating said slot.

3. The checkbook cover of claim 1, further comprising a heat-stamped reinforcement bordering said slot.

4. The checkbook cover of claim 2, wherein said force distributors further comprise circular holes.

5. The checkbook cover of claim 4, further comprising a heat-stamped reinforcement bordering said slot and said force distributors.

6. In combination, a checkbook cover having an exterior cover, an interior check and register holder affixed adjacent to said cover, and having a slot formed through said exterior cover, enlarged regions at each termination of said slot and a pen having a pocket clip thereon, said pen passing partially through said slot to a region between said exterior cover and said interior check and register holder, and said pocket clip encompassing at least a part of said exterior cover.

7. The combination checkbook cover and pen of claim 6, further comprising a heat-stamping bordering said exterior cover.

8. The combination checkbook cover and pen of claim 7, further comprising a heat-stamping bordering said slot and said enlarged regions.

* * * * *